US006050550A

United States Patent [19]

Burgess

[11] Patent Number: 6,050,550

[45] Date of Patent: Apr. 18, 2000

[54] APPARATUS FOR AERATION AND BOTTOM AGITATION FOR AQUA-CULTURE SYSTEMS

[76] Inventor: Harry L. Burgess, 5400 Memorial, #511, Houston, Tex. 77007

[21] Appl. No.: 09/112,480

[22] Filed: Jul. 9, 1998

[51] Int. Cl.[7] ..... B01F 3/04

[52] U.S. Cl. ..... 261/29; 261/91; 261/120; 261/121.1; 210/242.2; 119/215

[58] Field of Search ..... 261/29, 30, 36.1, 261/84, 91, 120, 121.1; 210/242.2; 43/57; 119/215

[56] References Cited

U.S. PATENT DOCUMENTS

| | | | |
|---|---|---|---|
| 3,017,951 | 1/1962 | Wiley | 183/2.5 |
| 3,189,334 | 6/1965 | Bell | 261/93 |
| 3,214,149 | 10/1965 | Budzien | 261/29 |
| 3,279,768 | 10/1966 | Niewiarowicz | 261/29 |
| 3,320,928 | 5/1967 | Smith | 119/3 |
| 3,347,371 | 10/1967 | Verbaere | 209/172 |
| 3,371,789 | 3/1968 | Hense | 210/169 |
| 3,635,342 | 1/1972 | Mourlon et al. | 210/84 |
| 3,756,578 | 9/1973 | McGurk | 261/91 |
| 3,800,462 | 4/1974 | Coyle | 43/57 |
| 3,815,277 | 6/1974 | Murray | 43/57 |
| 3,837,627 | 9/1974 | Sence et al. | 261/29 |
| 3,846,516 | 11/1974 | Carlson | 261/87 |
| 3,920,779 | 11/1975 | Abele | 261/87 |
| 3,940,461 | 2/1976 | Martin et al. | 261/91 |
| 4,003,796 | 1/1977 | Müller et al. | 195/142 |
| 4,029,724 | 6/1977 | Müller et al. | 261/87 |
| 4,051,204 | 9/1977 | Müller et al. | 261/36 |
| 4,086,306 | 4/1978 | Yoshinaga | 261/93 |
| 4,096,215 | 6/1978 | Albrecht | 261/121 |
| 4,140,737 | 2/1979 | Hauser | 261/93 |
| 4,142,972 | 3/1979 | Nebeker et al. | 210/84 |
| 4,215,082 | 7/1980 | Danel | 210/242.2 |
| 4,235,720 | 11/1980 | Nakajima et al. | 210/220 |
| 4,240,990 | 12/1980 | Inhofer et al. | 261/87 |
| 4,255,360 | 3/1981 | Jeffries | 261/5 |
| 4,280,911 | 7/1981 | Durda et al. | 210/629 |
| 4,290,885 | 9/1981 | Kwak | 210/197 |
| 4,297,214 | 10/1981 | Guarnaschelli | 210/219 |
| 4,328,175 | 5/1982 | Roeckel et al. | 261/91 |
| 4,348,288 | 9/1982 | Yoshinaga et al. | 210/708 |
| 4,382,804 | 5/1983 | Mellor | 55/1 |
| 4,409,100 | 10/1983 | Rajendren | 210/219 |
| 4,437,765 | 3/1984 | Seeger | 366/264 |

(List continued on next page.)

FOREIGN PATENT DOCUMENTS

| | | | |
|---|---|---|---|
| 28 23 515 | 12/1979 | Germany . | |
| 3208025 A1 | 9/1983 | Germany . | |
| 688308 | 3/1953 | United Kingdom . | |
| WO 88/07977 | 10/1988 | WIPO | 210/242.2 |

OTHER PUBLICATIONS

Mino–Mizer Live Bait Aerator brochure, 1 page, 1988.

WaterBuster Cordless Pump 4140 Operating Instructions, 1 page.

Atwood Mini King 350 and 500 Bilge Pumps 4100 and 4105 Installation Instructions, 2 pages.

PCT International Search Report Dated Oct. 29, 1999.

*Primary Examiner*—C. Scott Bushey

*Attorney, Agent, or Firm*—Thomason, Moser & Patterson, LLP

[57] ABSTRACT

The invention generally provides an apparatus that aerates the aquatic environment and agitates the bottom of the aquatic environment. One aspect of the invention provides a variable buoyancy aerator which cycles between an agitation mode and an aeration mode. Another aspect of the invention provides a system for maintaining an aqua-culture environment including one or more variable buoyancy aerators, a power source connected to supply power to activate the aerators and a controller connected to the power source to regulate activation of each aerator. The invention also provides a method for maintaining an aqua-culture environment including positioning one or more variable buoyancy aerators within the aqua-culture environment and regulating activation of each aerator to provide aeration, bottom agitation and controlled circulation to the aquatic environment.

21 Claims, 8 Drawing Sheets

U.S. PATENT DOCUMENTS

| | | | |
|---|---|---|---|
| 4,448,685 | 5/1984 | Malina | 210/219 |
| 4,454,077 | 6/1984 | Litz | 261/91 |
| 4,465,645 | 8/1984 | Kaelin | 261/87 |
| 4,581,181 | 4/1986 | Nicholls | 210/242.2 |
| 4,597,863 | 7/1986 | Rymal, Jr. | 210/117 |
| 4,620,925 | 11/1986 | Allen | 210/219 |
| 4,687,585 | 8/1987 | Ramshaw | 210/787 |
| 4,732,682 | 3/1988 | Rymal | 210/620 |
| 4,829,698 | 5/1989 | McDonald | 43/57 |
| 4,851,133 | 7/1989 | Rymal | 210/776 |
| 4,853,124 | 8/1989 | Terada | 210/242.2 |
| 4,917,577 | 4/1990 | Stirling | 417/66 |
| 4,994,177 | 2/1991 | Bogar, Jr. | 210/167 |
| 5,009,816 | 4/1991 | Weise et al. | 261/21 |
| 5,021,165 | 6/1991 | Kalins | 210/703 |
| 5,110,510 | 5/1992 | Norcross | 261/91 |
| 5,139,659 | 8/1992 | Scott | 210/169 |
| 5,213,718 | 5/1993 | Burgess | 261/93 |
| 5,275,762 | 1/1994 | Burgess | 261/4 |
| 5,316,671 | 5/1994 | Murphy | 210/220 |
| 5,354,457 | 10/1994 | Becchi | 210/170 |
| 5,595,691 | 1/1997 | Hsu | 261/120 |
| 5,906,774 | 5/1999 | Loy | 261/120 |
| 5,938,981 | 8/1999 | Burgess | 261/34.1 |

APPARATUS FOR AERATION AND BOTTOM AGITATION FOR AQUA-CULTURE SYSTEMS

BACKGROUND OF THE INVENTION

1. Field of the Invention

The invention generally relates to an apparatus and method for maintaining an aquatic environment. More particularly, the invention relates to an apparatus and method for maintaining oxygenation, providing bottom agitation and controlling circulation to an environment for aquatic livestock.

2. Background of the Related Art

Aqua-culture environments, such as ponds, tanks or other aquatic containment systems used for raising and maintaining fish or other aquatic livestock, typically need aeration to supply sufficient oxygen to the aquatic livestock. Without an aeration apparatus in the aquatic environment, the livestock may die due to lack of oxygen. In addition to the aeration apparatus, the aquatic environment needs agitation of the bottom surface to prevent stagnation of the bottom portion of the aquatic environment. Stagnation at the bottom of the aquatic environment leads to undesirable growth of bacteria and/or fungus in the aquatic environment which is detrimental to the health of the aquatic livestock. Agitation of the bottom of the aquatic environment also stirs up and redistributes the nutrients or food that have sunk to the bottom of the aquatic environment. The aquatic environment also requires a controlled circulation to prevent stagnant corners or regions.

Various aerators have been used to provide oxygenation to various aquatic environments. For example, U.S. Pat. No. 5,275,762, hereby incorporated by reference, discloses a floating aerator that is useful for aerating a top portion of an aquatic environment. The '762 patent also discloses an alternative embodiment that is fixedly attached to a bottom of the aquatic environment to provide aeration to the bottom portion of the aquatic environment. However, typical aerators are not capable of providing aeration at various vertical positions within the aquatic environment as well as agitation to the bottom of the aquatic environment. Furthermore, these aerators do not provide a scheme for controlling circulation within the aquatic environment.

Therefore, there remains a need for an apparatus that aerates the aquatic environment and agitates the bottom of the aquatic environment. It would be desirable for the apparatus to aerate the aquatic environment at various vertical positions. There is also a need for a method for maintaining oxygenation, providing bottom agitation and controlling circulation to an environment for aquatic livestock.

SUMMARY OF THE INVENTION

The invention generally provides an apparatus that aerates the aquatic environments at various vertical positions as well as agitates the bottom of the aquatic environment. One aspect of the invention provides a variable buoyancy aerator comprising: a pump, such as a centrifugal or vane pump, having a pump inlet disposed centrally at an upper surface, an impeller disposed below the pump inlet, one or more pump outlets extending outward from the impeller and a motor connected to rotate the impeller; a liquid inlet fluidly connected to the pump inlet; and an evacuable float disposed above the pump, the float comprising a float compartment having a bottom orifice fluidly connected to the pump inlet and an upwardly extending air inlet tube.

Another aspect of the invention provides a system for maintaining an aqua-culture environment comprising one or more variable buoyancy aerators, a power source electrically connected to supply an electrical power to activate the aerators and a controller connected to the power source to regulate activation and elevation of each aerator. Preferably, the apparatus includes a monitoring system that senses the conditions of the aqua-culture environment and sends signals to the controller to achieve and maintain a desired condition in the aquatic environment.

The invention also provides a method for maintaining an aqua-culture environment comprising positioning one or more variable buoyancy aerators within the aqua-culture environment and regulating activation of each aerator. The method provides aeration, bottom agitation and controlled circulation to an environment for aquatic livestock.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
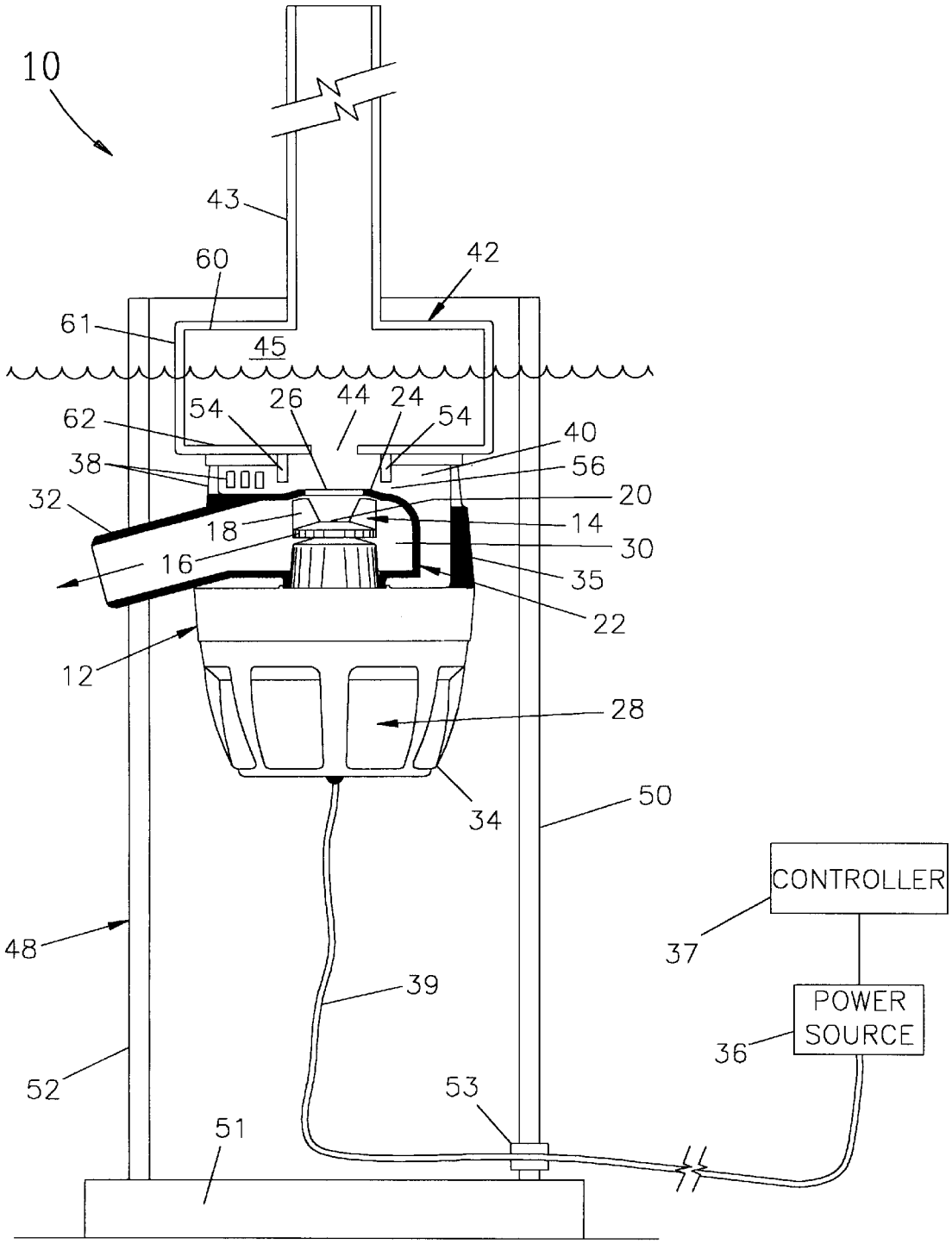
FIG. 1 is a cross sectional view of one embodiment of a variable buoyancy aerator according to the invention.
Figure 1A:
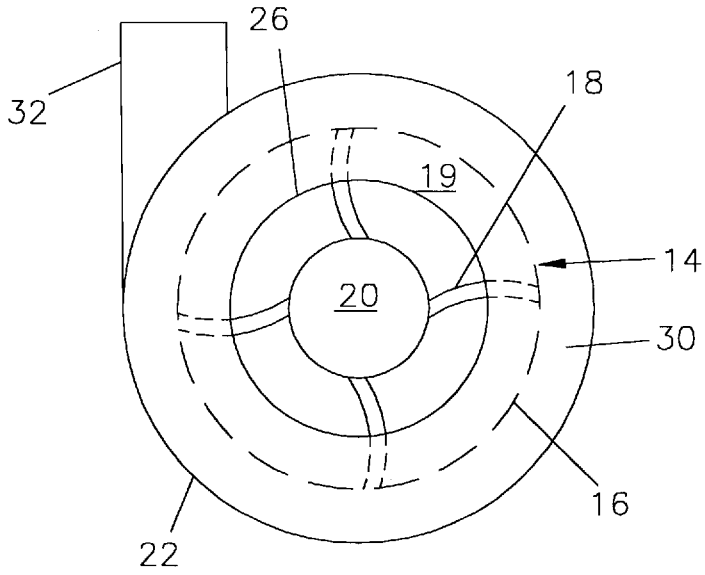
FIG. 1*a* is a top view of an impeller disposed within an impeller housing.
Figure 1B:
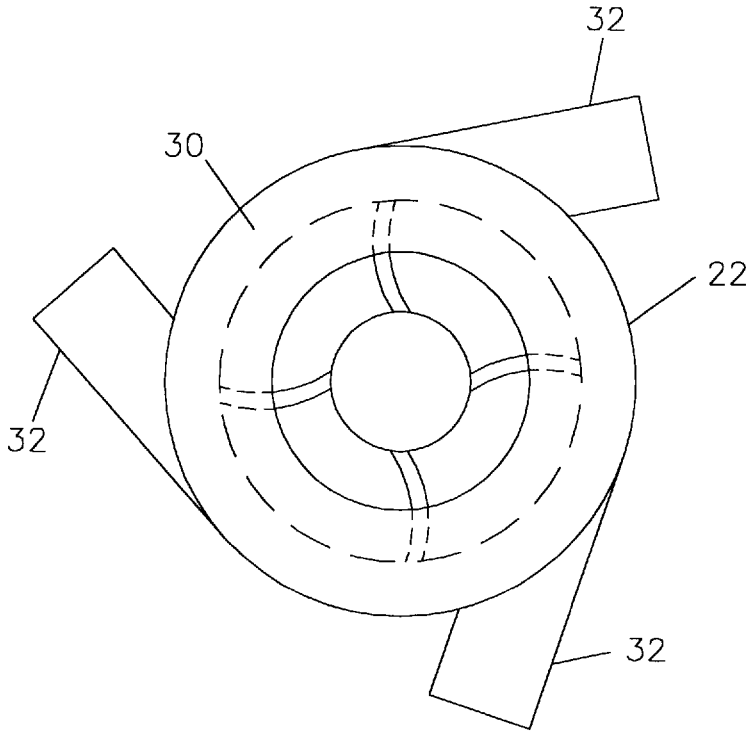
FIG. 1*b* is a top view of an alternate embodiment of the invention showing a plurality of pump outlets.

FIG. 1 is a cross sectional view of one embodiment of a variable buoyancy aerator according to the invention with accompanying details referenced in FIGS. 1*a* and 1*b*. The variable buoyancy aerator 10 generally comprises a pump 12 (which may be centrifugal or vane or other suitable types) and an evacuable float 42 disposed above the pump 12. A power source 36 is electrically connected to the pump 12 through electrical wires 39, and a controller 37 is connected to the power source 36 to regulate operation of the aerator 10. As shown in FIG. 1, the aerator is disposed within a guide 48 that confines the lateral movement of the aerator 10 within the aquatic environment.

The pump 12 generally comprises a pump inlet 26, an impeller 14 disposed below the pump inlet 26, one or more pump outlets 32 extending outward (such as radially which for the purposes of the present invention would also include tangentially directed outlets) from the impeller 14 and a motor 28 connected to rotate the impeller 14. FIG. 1*a* is a top view of an impeller 14 disposed within an impeller housing 22. The pump 12 includes a hubbed, vaned, rotary impeller 14 connected to and driven by a motor 28. The impeller 14 includes a disk-like bottom plate 16 and a plurality of blades 18 rigidly mounted on the upper surface of the plate 16. The blades 18 extend generally radially from an eye 20 defined in a central portion of the bottom plate 16. A plurality of flow passages 19 are defined between the blades 18. As shown in FIG. 1*a*, the blades 18 curve radially and tangentially in a well-known manner for impeller designs.

The impeller 14 is generally positioned in a central portion of an impeller housing 22. A generally annular outer region 30 is defined between the impeller 14 and a side wall of the impeller housing 22. As shown in FIGS. 1 and 1*a*, a pump outlet 32 extends radially outwardly from the annular outer region 30. Alternatively, as shown in FIG. 1*b*, a plurality of pump outlets 32 extend outwardly from the annular outer region 30 in a plurality of radial directions. The impeller housing 22 has a top wall 24 (shown in FIG. 1) that closely overlies a majority of the radially outermost portion of the blades 18 (i.e., at least half of the blade length). The top wall 24 of the impeller housing 22 has a central, axially upwardly opening pump inlet 26 that overlies and exposes the eye 20 of the impeller 14 and the radially innermost portion of the blades 18.

Water enters the pump 12 through the pump inlet 26 in an axial direction and passes into the eye 20 and the innermost parts of the flow passages 19. When the impeller 14 is rotating relative to the housing 22, as will be described below, the water is accelerated by centrifugal force. The direction of the water flow becomes radial as the water is thrown outwardly through the flow passages 19 between the blades 18. The water then passes into the outlet region 30 and out through one or more pump outlets 32.

The motor 28 is preferably contained within a waterproof motor casing 34 and disposed below the impeller 14 and housing 22. The motor 28 includes a motor drive shaft (not shown) extending upwardly through the impeller housing 22 into the impeller 14 to rotate the impeller 14. The motor may be an AC or DC motor. In other embodiments the motor may be other than an electrical motor. For instance, hydraulic motors would fall into this category. Other power sources are available. In some embodiments, the motor may be a variably controlled motor such that varying outputs may be maintained. Thus, it may be possible to control even the elevation at predetermined intermediate elevations by considering the output in relation to the available inflow of fluid and air to the pump. In this sense, the controller may offer more regulation options than an on/off controller and may be variably adjusted. Preferably, the motor 28 receives electrical power from an external power source 36 through a set of electrical wires 39, and a controller 37 regulates the electrical power supplied to the motor 28. Preferably, the controller 37 comprises a microprocessor that is programmable to switch between periods of activation (electrical power being supplied to the motor) and deactivation (electrical power not supplied to the motor) of the variable buoyancy aerator 10. When a plurality of aerators 10 are being controlled in a system for maintaining an aquatic environment, the controller 37 may be programmed to activate/deactivate the aerators in particular timing schemes, such as synchronously and sequentially. Alternatively, the controller 37 comprises a simple timing circuit or a timer that switches between on/off states of the electrical power delivered to the motor 28.

Instead of an external power source, a self-contained power source, such as a battery pack (not shown), may be attached to the motor casing 34 to supply electrical power to the motor 28. A timer or a simple timing circuit (not shown) may be used in conjunction with the battery pack to control a switch (not shown) that selectively completes or breaks the connection between the battery pack and the motor.

The motor casing 34 includes an upper wall 35 that surrounds the impeller housing 22 except for the pump outlet 32. The upper wall 35 extends above the impeller housing 22 and abuts the underside of the float 42. A cavity 40 is defined between the upper wall 35, the impeller housing 22 and the underside of the float 42. The upper wall 35 includes an annular top portion having strainer holes 38 integrally formed therein. The strainer holes 38 allow the entry of water into the cavity 40, but prevent the passage of debris that could clog or plug the pump and cause pump failure. The strainer holes may further have screen(s) connected to the holes to further restrict the passage of unwanted materials. The strainer holes 38 may be directionally oriented or vaned to assist in directing the inlet of fluid. In some embodiments, the direction may offset or counter the natural rotation of the aerator caused by the inertia of the rotating impeller as described more in the '762 patent referenced above. An annular restraining wall 54 extends downwardly from the underside of the float 42 toward the top wall 24 of the impeller housing 22 to form a water control annulus 56. Naturally, other openings and methods could be used to restrict the flow of water or even other fluids to the impeller, and thus, the term "annulus" would include any such openings regardless of whether it was circular or other shapes, continuous about the periphery or in segmented openings, or other variations. (Similarly, the term "circumferentially" is not restricted to a circularly shaped object, but includes any variety of shapes such as rectangular, elliptical, or other polygonal shapes.) The water control annulus 56 limits the amount of the water flowing into the pump inlet 26 to an amount below the pump handling capacity so that the pump 12 draws fluids (either air or water depending on the mode of operation as discussed below) from the float 42 for the remainder of the pump capacity. Preferably, the water control annulus 56 limits the amount of the water flowing into the pump inlet 26 near a point on a pump curve where cavitation may occur.

An evacuable float 42 is attached to a top portion of the variable buoyancy aerator 10. The float 42 comprises an evacuable compartment 45 having an upwardly extending air inlet tube 43 and a bottom orifice 44 aligned above the pump inlet 26. The compartment 45, defiled by a top 60, a bottom 62 and a side wall 61 extending between the top 60 and the bottom 62, is sized (internal volume) proportionately to the weight of the aerator 10 to provide sufficient buoyancy to float the aerator when the compartment 45 is filled with air. As shown in FIG. 1, the air inlet tube 43 extends from the top 60 of the compartment 45 and provides an air passage into the compartment 45. The air inlet tube 43 is preferably longer than the depth of the aquatic environment so that when the variable buoyancy aerator is resting at the bottom of the aquatic environment, one end of the air inlet tube 43 extends above the surface of the aquatic environment. The bottom of the compartment 45 includes a bottom orifice 44 positioned above the pump inlet 26 to provide an air passage to the pump inlet 26. The bottom orifice 44 is preferably smaller in diameter as compared to the diameter of the pump inlet 26 to restrict fluid flow from the compartment 45 when the float is completely or partially filled with water. However, the bottom orifice 44 is sized to provide a sufficient supply of air to the impeller 14 when the float is filled with air. The size of the bottom orifice 44 is a factor in determining the flow rate of fluids from the compartment 45 and the time required to empty a compartment 45 that is filled with water. The opening size of the orifice may be varied or adjusted in some embodiments. For instance, a hole with an adjustable needle could be used. Also, a variety of interchangeable orifices with different sizes could be used to alter the opening. Thus, the size of the bottom orifice 44 is a factor in determining the time required for the aerator 10 to switch between a pumping mode and an aerating mode (discussed below).

The float 42, when filled with air, provides buoyancy to the variable buoyancy aerator to adequately support the entire variable buoyancy aerator 10 in a floating position. At the floating position, as shown in FIG. 1, the top surface of the aquatic environment is at about a middle section of the float 42, and the pump 12 is submerged below the top surface of the aquatic environment.

The variable buoyancy aerator 10 is preferably disposed within an aerator guide 48 that confines the lateral movement of the aerator 10 within the aquatic environment while allowing vertical travel of the aerator. As shown in FIG. 1, the aerator guide 48 comprises a guide sleeve 50 having an inner diameter slightly larger than the largest outer diameter of the variable buoyancy aerator 10 and a weight support 51, such as a concrete block, to secure the guide sleeve 50 on the bottom of the aquatic environment. The guide sleeve 50 includes a slot 52 running from a bottom portion to a top portion of the guide sleeve 50 through which the pump outlet 32 protrudes. The guide sleeve 50 guides the vertical movement of the variable buoyancy aerator 10, and the slot 52 determines the radial direction of the pump outlet 32. The slot 52 can be a vertical slot that confines the pump outlet 32 in one direction, a spiral slot that rotates the direction of the pump outlet 32 or in other shapes that provide a path for the movement of the pump outlet 32 as the variable buoyancy aerator 10 travels vertically within the guide sleeve 50. The electrical wire 39 attached to the motor 28 is preferably introduced through a hole 53 disposed at the bottom of the guide sleeve 50 to minimize the possibility of entanglement with the variable buoyancy aerator 10 as the aerator moves vertically. Other devices, such as a pole and ring device wherein one or more rings attached to the aerator are looped over a vertically extending pole fixedly positioned in the aquatic environment, could be used to confine the lateral movement of the aerator within the aquatic environment while guiding the vertical movement of the aerator.

The pump 12 is adapted for continuous operation between an aerating mode and a pumping mode. In the aerating mode, the pump 12 takes in a controlled amount of water from the aquatic environment and air through the air inlet tube 43 extending above the float 42. The mixture of air and water is pumped out through the pump outlet 32 to provide aeration to the aquatic environment. In the pumping mode, the float 42 is flooded with water so that the supply of air to the pump 12 is substantially cut off, causing the pump 12 to draw in only water and discharge the water under pressure through the pump outlet 32. An aerator which is adapter to operate in either an aerating mode or a pumping mode is described in U.S. Pat. No. 5,275,762 which is incorporated herein by reference for all purposes.

While in the above described embodiment, the outlet is positioned above the motor, such an arrangement is not crucial to accomplish the goals of the present invention. In some embodiments, the outlet could be below the pump. For instance, an annulus or conduit directing the fluid from the pump inlet through the impeller to an opening located below the motor many be used (which fluid flow might offer some cooling benefits to the motor to the extent that some cooling is desired).

Figure 2:
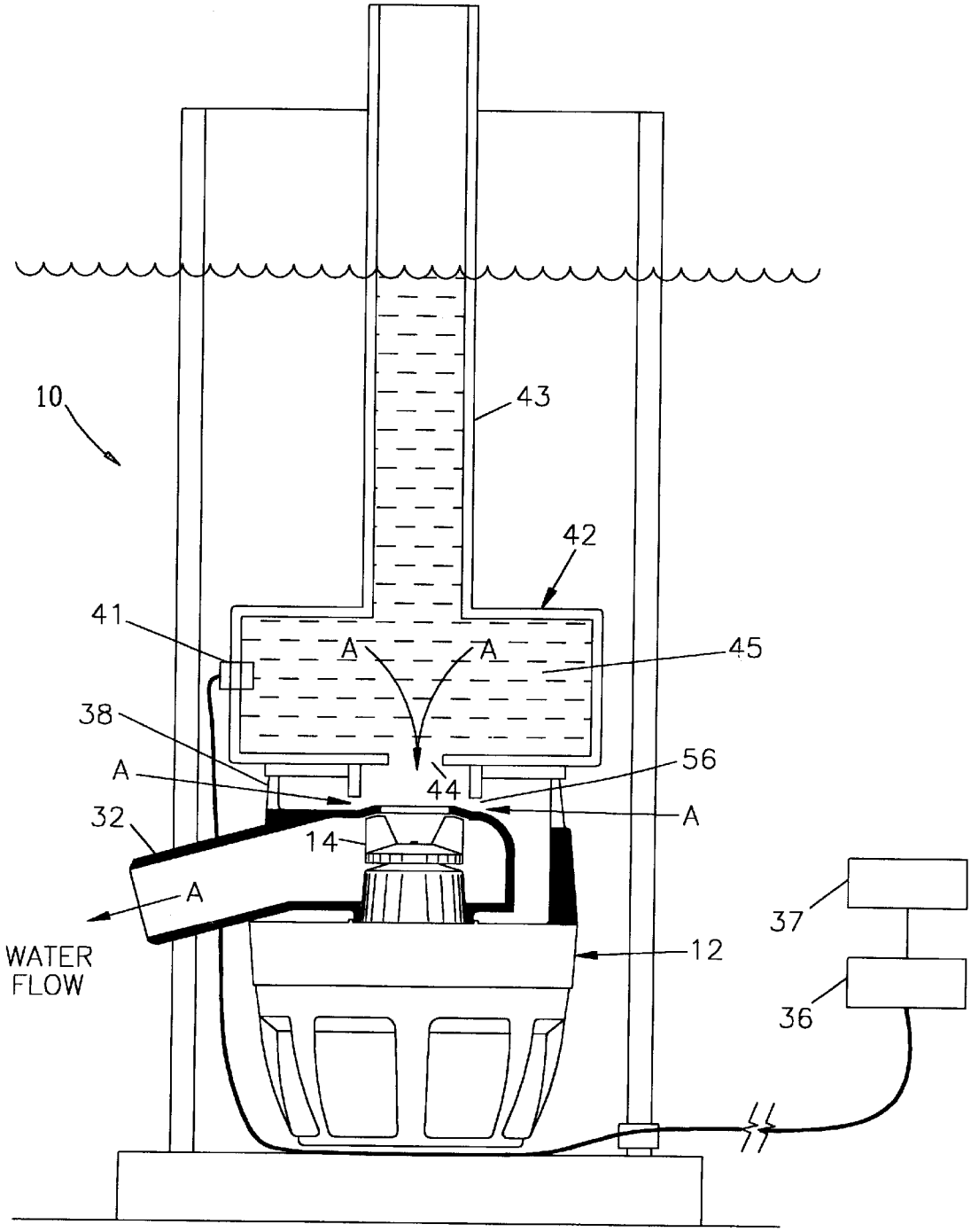
FIG. 2 is a cross sectional view of the variable buoyancy aerator in a fully water pumping mode.

FIGS. 2–6 illustrate the operation cycle of a variable buoyancy aerator according to the present invention. FIG. 2 is a cross sectional view of a variable buoyancy aerator in a pumping mode. As shown, the variable buoyancy aerator 10 is resting at its lowest position near the bottom of the aquatic environment. The float 42 and the pump 12 are filled with water, and the portion of the air inlet tube 43 below the surface of the aquatic environment is also filled with water. To begin the water pumping mode, the controller 37 activates the variable buoyancy aerator 10 by supplying electrical power from the power source 36 to the pump 12. As the impeller 14 rotates, water is drawn from both the water control annulus 56 and the bottom orifice 44 of the float 42 and pumped out through the pump outlet 32. The direction of the water flout is indicated by arrows A. The pump outlet 32 is preferably pointing at a downward angle that promotes agitation of the bottom of the aquatic environment. When the pump reaches full capacity pumping speed, water is pumped out of the variable buoyancy aerator 10 with such force that agitation of the bottom of the aquatic environment occurs. As more water is pumped through the outlet 32 than can be drawn through strainer holes 38 and annulus 56, water is drawn from the compartment 45 of the float 42. Air is then drawn through the air inlet tube 43 and begins to fill the compartment 45 of the float 42. Filling the float 42 with air creates a buoyant force that lifts the variable buoyancy aerator 10 from the bottom resting position and moves the variable buoyancy aerator 10 upwardly toward the surface of the aquatic environment. Typically, after a substantial portion (i.e., about one-half) of the compartment 45 is filled with air, the pump 12 begins to draw in air as well as water and starts an initial aerating mode.

Figure 3:
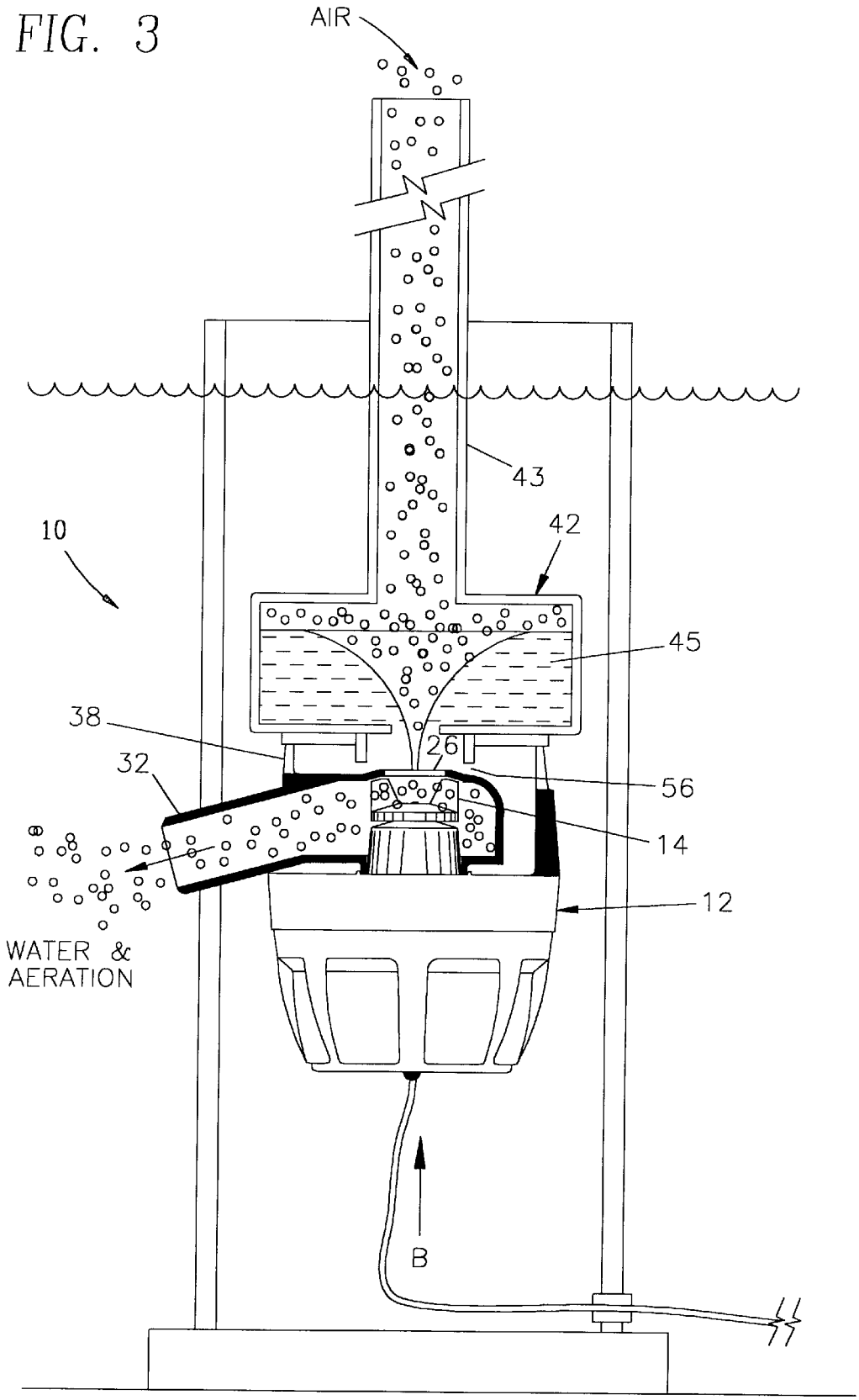
FIG. 3 is a cross sectional view of the variable buoyancy aerator in an initial aerating mode.

FIG. 3 is a cross sectional view of the variable buoyancy aerator in an initial aerating mode. The impeller 14 creates a vortex of the water above the pump inlet 26 in a central region of the compartment 45 of the float 42 and draws air along with the residual water in the float 42 into the pump 12. The impeller 14 forces the air along with the water through the pump outlet 32 to provide aeration into the aquatic environment. As more water is drawn out of the float 42, more air enters the compartment 45 of the float 42 and is drawn into the pump inlet 26 by the impeller 14. The variable buoyancy aerator 10 continues to move upwardly (as indicated by arrow B) with additional filling of air in the compartment 45. As the float 42 becomes completely filled with air, the variable buoyancy aerator 10 acquires its maximum buoyancy and floats near the surface of the aquatic environment and begins to operate in an aerating mode.

The time required to completely draw out the water in the compartment 45 corresponds to a dwell time required for the aerator 10 to switch from a pumping mode to an aerating mode. The size of the compartment 45, the size of the bottom orifice 44, the size of the water control annulus 56 and the pumping capacity are factors that determine the dwell time. Thus, by controlling the various ratios of the above factors, the dwell time may be adjusted. Similarly, by controlling the various ratios, the operating depth of the aerator in the water may also be controlled. Faster air intake might correspond to a higher level in the water and so forth.

The inventor has discovered that use of the annulus may also have an effect on the amperage required to operate the motor. For instance, the present invention appears to have less amperage requirements with the entrained air. Thus, amperage control is also possible with this invention.

Also, shown in FIG. 2 is a control valve 41. In some embodiments, it may be desired to rapidly, or at least independently of the annulus/orifice/compartment size/pumping capacity factors, control the elevation of the aerator. The control valve may be an open/closed valve such as a solenoid valve or some variably positioned valve that can be opened to an intermediate position. It can be controlled remotely by some circuit. Alternatively, it may be a mechanically or chemically opening valve (or some other means) that could for instance be actuated with pressure or other conditions. By opening the control valve, an independent method of allowing the fluid into the chamber 45 may be had.

Figure 4:
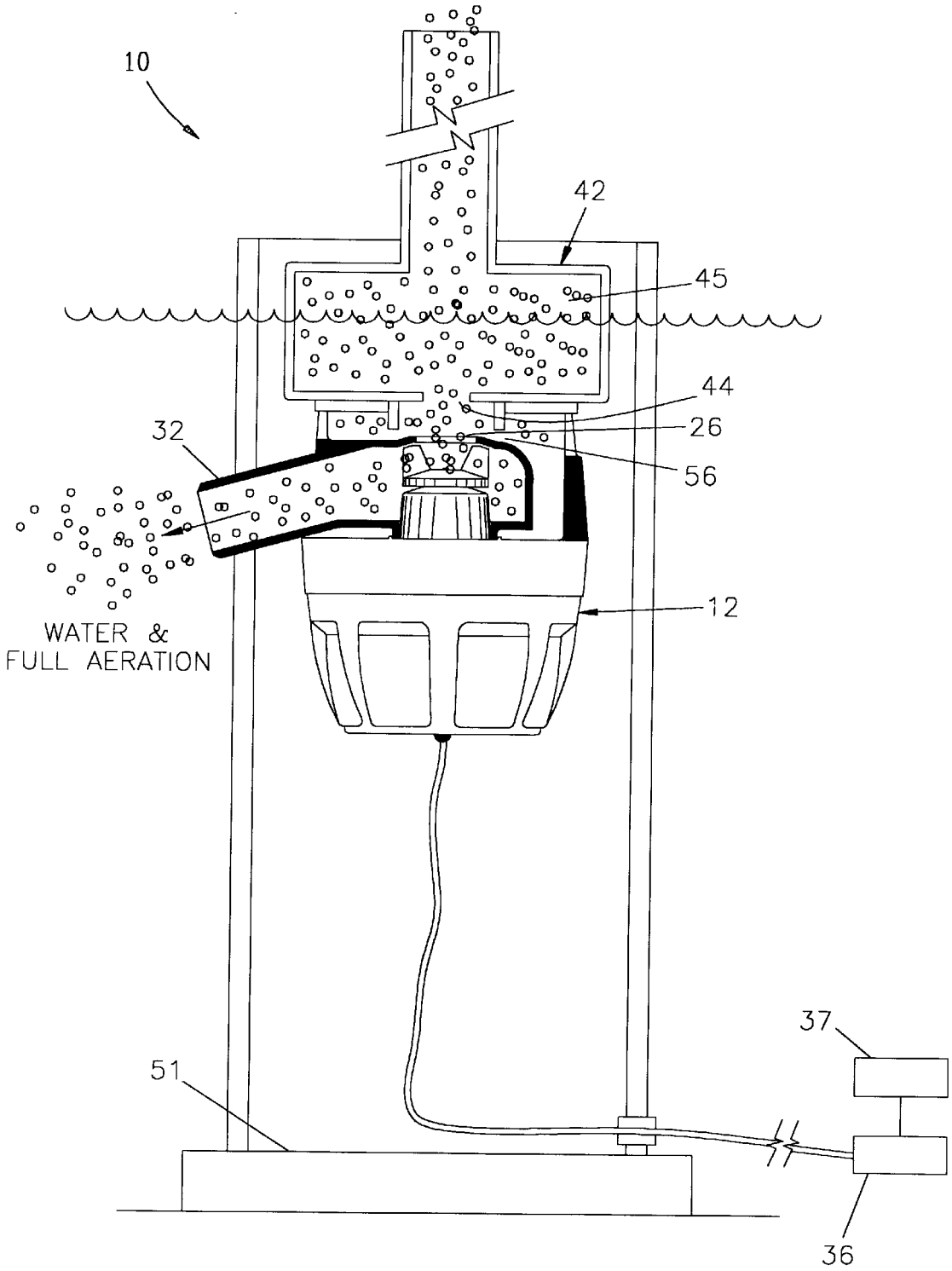
FIG. 4 is a cross sectional view of the variable buoyancy aerator in a full aerating mode.

FIG. 4 is a cross sectional view of the variable buoyancy aerator in an aerating mode. The variable buoyancy aerator 10 provides the maximum aeration in the aerating mode because water only enters into the pump inlet 26 through the water control annulus 56. With the float 42 filled completely with air, the variable buoyancy aerator 10 acquires its maximum buoyancy and its highest vertical position within the aquatic environment. The variable buoyancy aerator 10 is kept activated in the aerating mode for a period of time necessary to achieve the desired oxygenation level of the aquatic environment. After the desired oxygenation level has been achieved, the controller 37 shuts off the electrical power supplied to the pump 12, and the variable buoyancy aerator 10 is deactivated.

Figure 5:
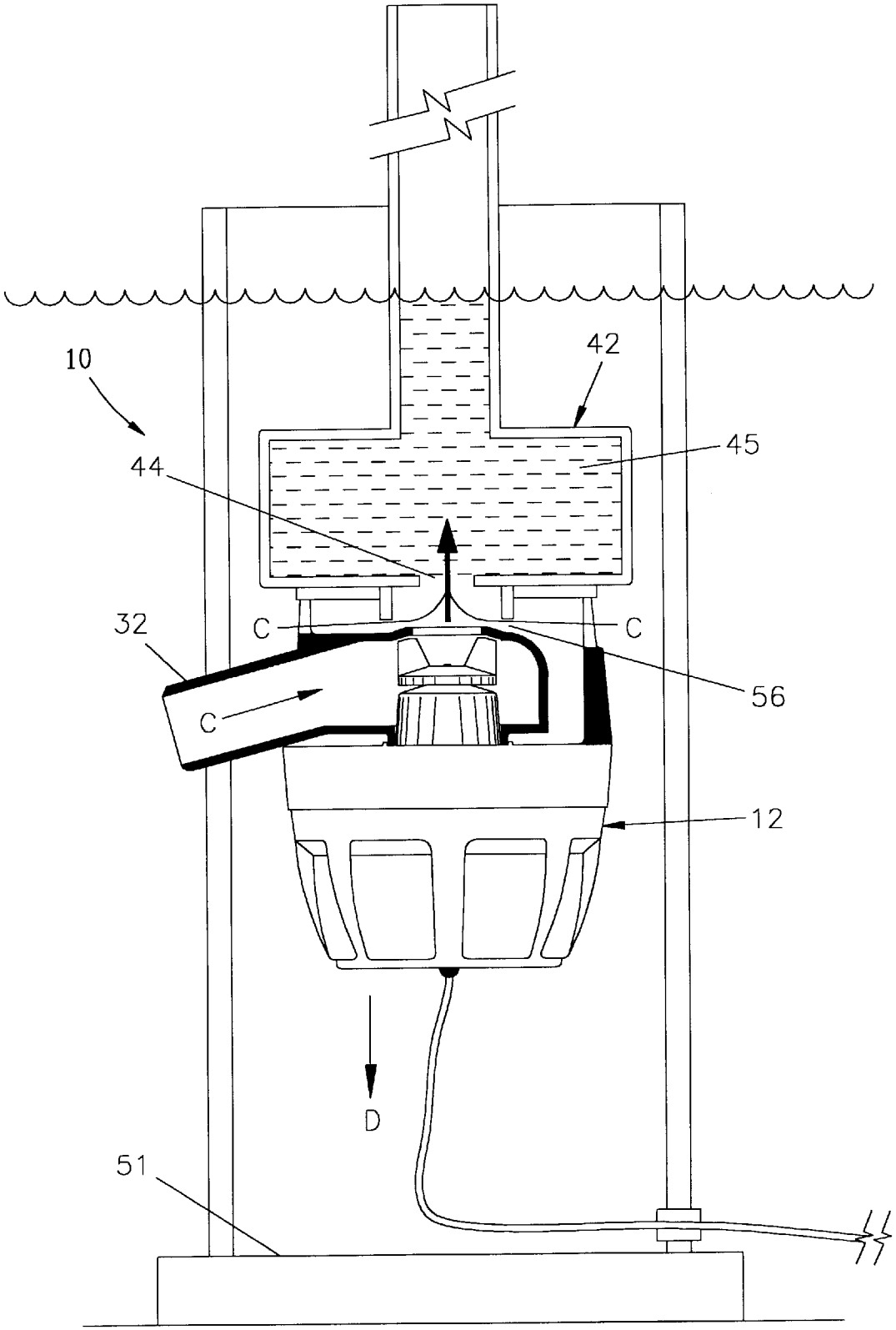
FIG. 5 is a cross sectional view of the variable buoyancy aerator after deactivation.

FIG. 5 is a cross sectional view of the variable buoyancy aerator after deactivation. Because the pump 12 is shut off, air is no longer drawn into the pump 12, and water begins to fill compartment 45 of the float 42 through the water control annulus 56, and then through the bottom orifice 44. The flow of the water is indicated by arrows C. As the float 42 becomes filled with water, the variable buoyancy aerator 10 loses its buoyancy and begins to sink (as indicated by arrow D). The variable buoyancy aerator 10 continues to sink until it reaches some predetermined level, such as weight support 51 or the bottom of the aquatic environment.

Figure 6:
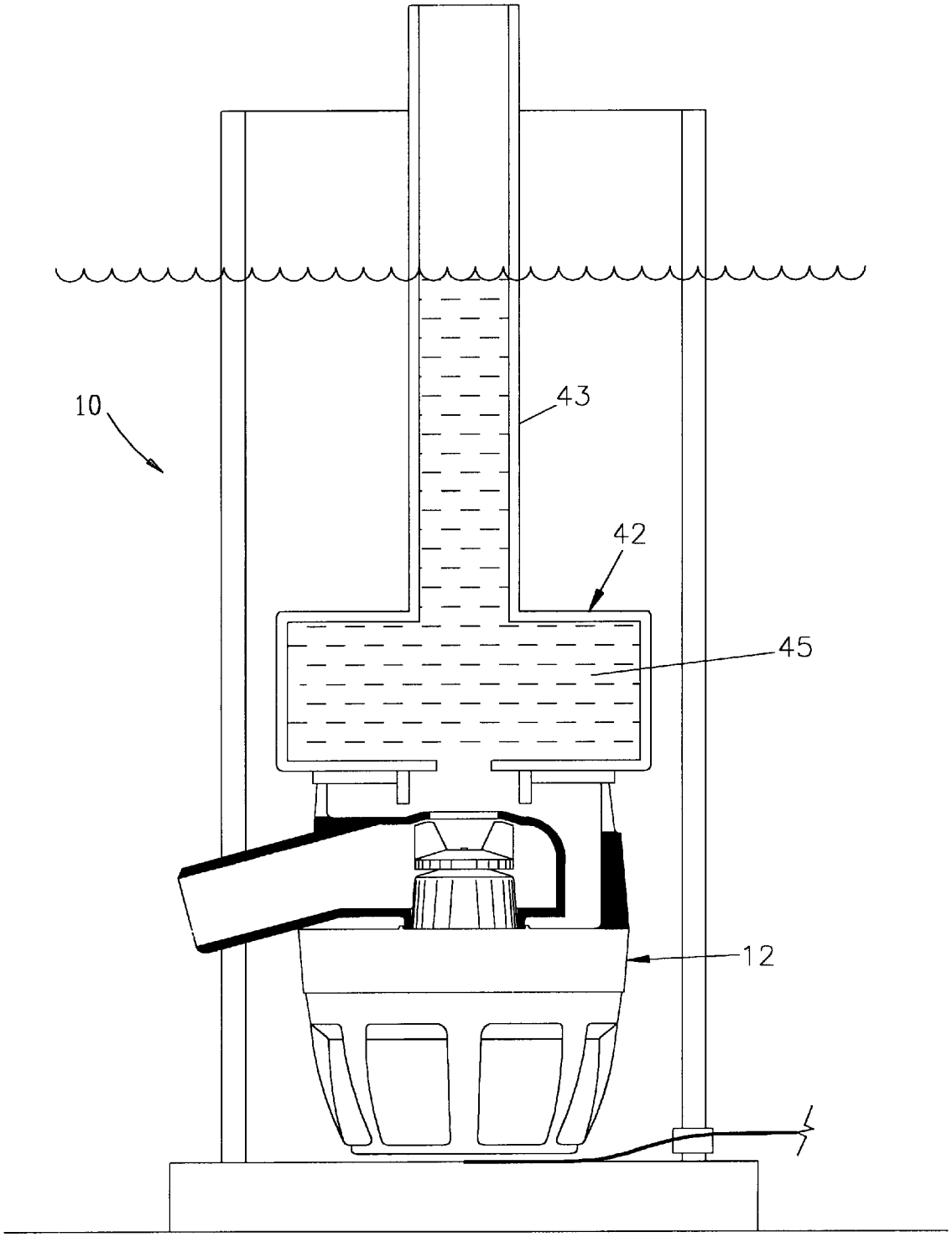
FIG. 6 is a cross sectional view of the variable buoyancy aerator in a deactivated stage.

FIG. 6 is a cross sectional view of the variable buoyancy aerator in the deactivated stage. As shown, the pump 12, the compartment 45 of the float 42 and the portion of the air inlet tube 43 below the surface of the aquatic environment are completely filled with water, and the variable buoyancy aerator 10 is resting at the lower limit of its travel, such as near the bottom of the aquatic environment. The variable buoyancy aerator 10 is kept deactivated for a period of time until agitation and/or oxygenation of the aquatic environment is needed. When the pump 12 is energized again, the operation cycle of the variable buoyancy aerator 10, as illustrated in FIGS. 2–6, is repeated.

Figure 7:
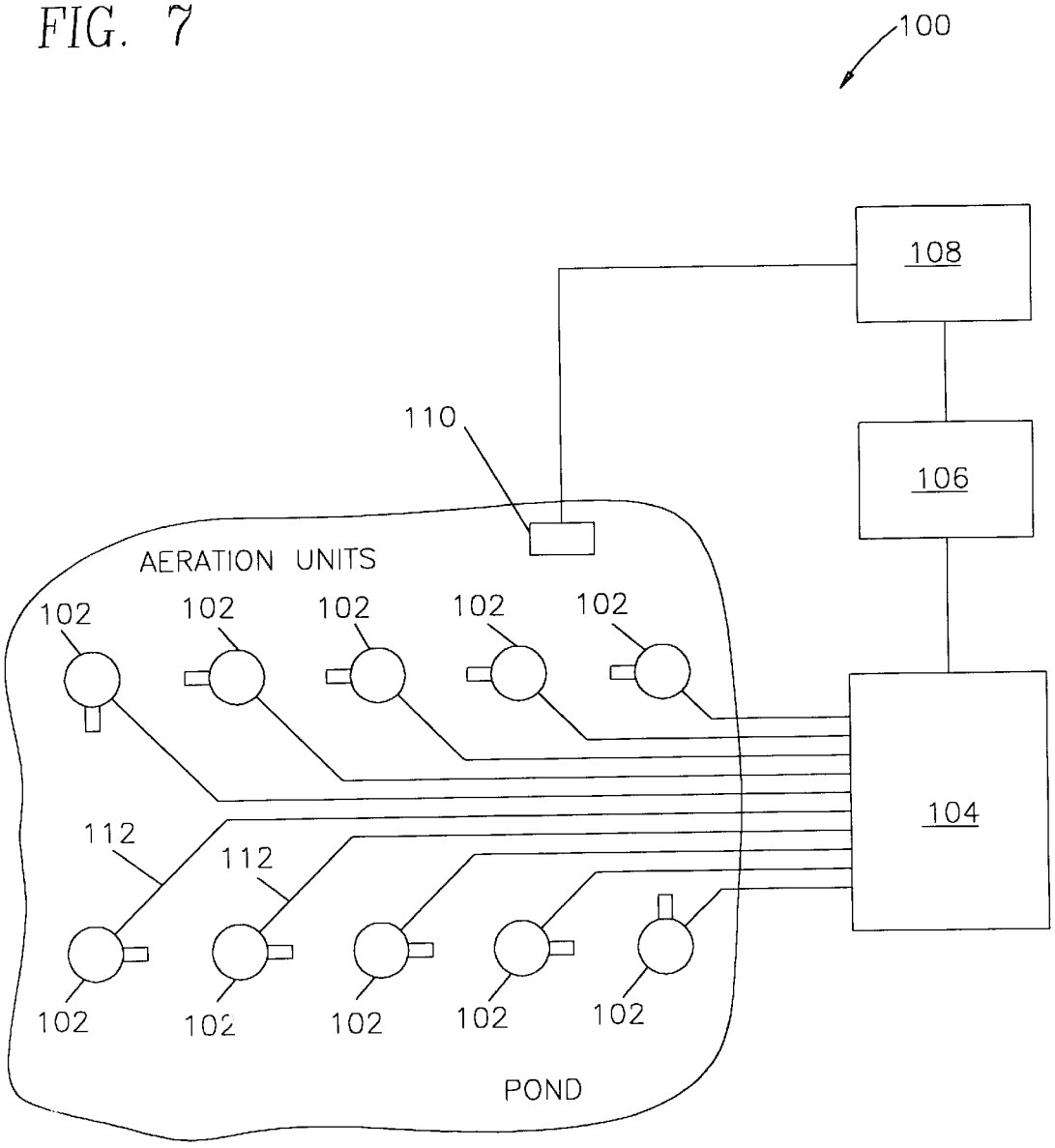
FIG. 7 is a schematic diagram of a system for maintaining an aqua-culture environment according to the invention.

To provide aeration and bottom agitation to the aquatic environment, one or more variable buoyancy aerators may be used depending on the size of the aquatic environment and the capacity of the variable buoyancy aerator used. FIG. 7 is a schematic diagram of an aeration system for maintaining an aqua-culture environment according to the invention. The system 100 for maintaining the aqua-culture environment generally comprises a plurality of variable buoyancy aerators 102, a power source 104 electrically connected to supply an electrical power to activate the aerators and a controller 106 connected to the power source to regulate activation of each aerator. The variable buoyancy aerators 102 may be connected individually through electrical wires 112 to the power source 104. Preferably, the electrical connections are water-proof and corrosion resistant to provide long, maintenance-free life. Electrical pipes, such as PVC pipes, can be used to protect the electrical wires from the aquatic environment as well as the aquatic animals maintained therein.

The controller 106, preferably a programmable controller or a microprocessor, regulates the activation of each variable buoyancy aerator by switching the electrical power supplied to each variable buoyancy aerator between on/off states or the variable states described above. As shown in FIG. 7, the controller 106 and the power supply 104 are separate units. Alternatively, the power supply 104 and the controller 106 can be a single unit component. The controller 106 may be programmed to activate the variable buoyancy aerator in a synchronized manner wherein all variable buoyancy aerators are activated and deactivated simultaneously. Alternatively, the controller 106 may be programmed to activate the variable buoyancy aerators in a sequential manner to create a wave-like effect from individual rising and sinking variable buoyancy aerators. Still further, the controller 106 may be programmed to randomly activate any of the variable buoyancy aerators.

Optionally, a monitoring system 108 is connected with the controller 106 to provide signals to the controller 106 that activates or deactivates the variable buoyancy aerators 102 upon appropriate conditions in the aquatic environment. The monitoring system 108 may comprise one or more sensors 110 disposed in the aquatic environment that senses conditions such as temperature, oxygen level and water flow, as could be available from various suppliers known to those with ordinary skill in the art. Typically, the monitoring system 108 sends a signal to the controller 106 to regulate activation of the variable buoyancy aerators 102 when the sensed condition needs changing and a signal to deactivate the variable buoyancy aerators 102 when the aquatic environment is in a desired condition. Preferably, the monitoring system 108 provides signals that trigger the controller 106 to activate or deactivate the variable buoyancy aerators 102 on an individual basis. The monitor system 108 may also include sophisticated microprocessors and/or sensors, such as a satellite monitoring system (not shown).

In addition to providing aeration and agitation, the system 100 provides controlled circulation in the aqua-culture environment and eliminates stagnant water flow regions. By positioning the variable buoyancy aerators 102 in a particular arrangement and pointing the pump outlets of each variable buoyancy aerator 102 in a particular direction, the system 100 can achieve specific water flow patterns. For example, by pointing the pump outlets in a sequential manner (i.e., each outlet points to the next aerator) when the variable buoyancy aerators are positioned as shown in FIG. 7, the system 100 provides a substantially oval circulation or agitation pattern. Preferably, the system 100 includes a plurality of aerators disposed throughout the aquatic environment to provide agitation to a substantial portion of the aquatic environment. Alternatively, each aerator 102 can include a plurality of outlets 32 (as shown in FIG. 1*b*) in a number of directions to increase the area agitated by each aerator.

While the foregoing is directed to preferred embodiments of the present invention, other and further embodiments of the invention may be devised without departing from the basic scope thereof. The scope of the invention is determined by the claims which follow.

I claim:

1. A system for maintaining an aqua-culture environment, comprising:

a) one or more variable buoyancy aerators, at least one of the aerators comprising a pump, a pump inlet, and one or more pump outlets fluidicly coupled to the pump inlet an air inlet fluidicly connected to the pump inlet, and an evacuable float fluidicly connected to the air inlet prior to the pump inlet;

b) a power source connected to supply power to activate the aerators; and c) a controller connected to the power source to regulate activation of each aerator.

2. The system of claim 1, wherein the pump comprises an impeller, one or more pump outlets extending outward from the impeller, and a motor connected to rotate the impeller and the aerator further comprises an orifice fluidicly connected to the pump inlet.

3. The system of claim 2, further comprising one or more aerator guides fixedly disposed in the aqua-culture environment to maintain the location of the one or more aerators.

4. The system of claim 3, wherein each aerator guide comprises a guide sleeve sized and adapted to receive the aerator therein, the guide sleeve having a slot through which the pump outlet extends.

5. The system of claim 1, wherein the controller is a programmable controller.

6. The system of claim 5, further comprising a monitoring system connected to the controller to regulate the aerators.

7. The system of claim 6, wherein the pump comprises an impeller, one or more pump outlets extending outward from the impeller, and a motor connected to rotate the impeller and the aerator further comprises an orifice fluidicly connected to the pump inlet.

8. The system of claim 7, further comprising one or more aerator guides fixedly disposed in the aqua-culture environment to maintain the location of the one or more aerators.

9. The system of claim 8, wherein each aerator guide comprises a guide sleeve sized and adapted to receive the aerator therein, the guide sleeve having a slot through which the pump outlet extends.

10. A variable buoyancy aerator, comprising:

a) a pump having a pump inlet and one or more pump outlets fluidicly coupled to the inlet; and b) an evacuable float connected to the pump, the float comprising a float compartment fluidicly connected to the pump inlet and an air inlet.

11. The aerator of claim 10, further comprising an orifice fluidicly connected to the pump inlet.

12. The aerator of claim 11, wherein the liquid inlet further comprises an annulus disposed circumferentially about the pump inlet.

13. The aerator of claim 10, further comprising a power source connected to the pump.

14. The aerator of claim 13, wherein the power source provides a periodic electrical power.

15. The aerator of claim 13, further comprising a controller connected to the power source to regulate activation of the pump.

16. The system of claim 2, wherein the pump comprises a centrifugal pump.

17. The system of claim 2, wherein the pump comprises a vane pump.

18. The system of claim 2, wherein the orifice comprises an adjustably sized orifice opening fluidicly connected to the pump inlet.

19. The aerator of claim 10, wherein the pump comprises a centrifugal pump.

20. The aerator of claim 10, wherein the pump comprises a vane pump.

21. The aerator of claim 11, wherein the orifice comprises an adjustably sized orifice opening fluidicly connected to the pump inlet.

* * * * *

UNITED STATES PATENT AND TRADEMARK OFFICE

CERTIFICATE OF CORRECTION

PATENT NO. : 6,050,550

DATED : April 18, 2000

INVENTOR(S) : Harry L. Burgess

It is certified that error appears in the above-indentified patent and that said Letters Patent is hereby corrected as shown below:

In column 4, line 51, after "compartment 45", please replace "defiled" with "defined".

In column 6, line 20, after "water", please replace "flout" with "flow".

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*